US005279366A

United States Patent [19]

Scholes

[11] Patent Number: 5,279,366

[45] Date of Patent: Jan. 18, 1994

[54] METHOD FOR WIRELINE OPERATION DEPTH CONTROL IN CASED WELLS

[76] Inventor: Patrick L. Scholes, 14043 W. Alaska Dr., Lakewood, Colo. 80228

[21] Appl. No.: 939,069

[22] Filed: Sep. 1, 1992

[51] Int. Cl.[5] ..... E21B 43/119; E21B 47/04; E21B 49/04

[52] U.S. Cl. ..... 166/254; 166/66; 166/66.5; 166/242; 166/255; 166/297; 250/257

[58] Field of Search ..... 166/66, 66.5, 242, 250, 166/254, 255, 297; 250/257

[56] References Cited

U.S. PATENT DOCUMENTS

| | | | |
|---|---|---|---|
| 2,652,496 | 9/1953 | Herzog et al. | 166/254 X |
| 2,728,554 | 12/1955 | Goble . | |
| 2,957,083 | 10/1960 | Scherbatskoy | 250/257 |
| 3,019,841 | 2/1962 | Ternow | 166/55.1 |
| 3,106,960 | 10/1963 | Doak | 166/66 |
| 3,144,876 | 8/1964 | Frye . | |
| 3,145,771 | 8/1964 | Pennebaker . | |
| 3,288,210 | 11/1966 | Bryant . | |
| 3,291,207 | 12/1966 | Rike . | |
| 3,291,208 | 12/1966 | Kenneday . | |
| 3,396,786 | 8/1968 | Shuster . | |
| 3,570,594 | 3/1971 | Hamilton | 166/64 |
| 3,776,323 | 12/1973 | Spidell et al. | 175/4.51 |
| 4,189,705 | 2/1980 | Pitts, Jr. | 250/262 |
| 4,244,424 | 1/1981 | Talbot | 166/66 |
| 4,465,140 | 8/1984 | Hoehn, Jr. | 166/381 |

OTHER PUBLICATIONS

Blaskowsky, Douglas W., "Magnetic markers simplify well depth correlations", World Oil, Nov., 1979, pp. 64–68.

*Primary Examiner*—George A. Suchfield
*Attorney, Agent, or Firm*—Dorr, Carson, Sloan & Peterson

[57] ABSTRACT

Wireline operation depth control in cased wells can be substantially improved by attaching a combined magnetic and radioactive marker to the casing in the vicinity of the zone of interest. A cased hole log is then performed, such as a perforation depth control (PDC) log, using both a casing collar locator and a gamma ray sensor. The marker produces distinctive spikes on the logs from both sensors. The casing collar log is tied in to the gamma ray log simply by aligning these distinctive spikes on both logs. This helps to ensure that subsequent cased hole wireline operations, such as perforating, that rely solely on a collar locator for depth control are performed at the correct depth.

17 Claims, 7 Drawing Sheets

METHOD FOR WIRELINE OPERATION DEPTH CONTROL IN CASED WELLS

BACKGROUND OF THE INVENTION

1. Field of the Invention

The present invention relates generally to the field of depth control for accurate location of tools and other equipment in cased wells during wireline operations. More specifically, the present invention discloses an improved method of wireline operation depth control using a collar with both magnetic and radioactive markers to ensure accurate correlation between the gamma ray radiation log and perforating depth control log.

2. Statement of the Problem

Most modern wells, after being drilled, have at least a minimum logging program run on them before casing is set. A "log" is generally a graph of a particular instrument reading, with one axis being depth within the well. These readings are usually rock characteristics, such as natural gamma ray radiation, response to nuclear bombardment, resistivity, electrochemical properties, or acoustic wave transfer properties. There are others, of course, but the foregoing list encompasses the primary groups of logs. A logging program is then defined as the particular log, or logs, run on the well. The number or type of logs (i.e. the number of rock parameters measured and the level of log sophistication) is a function of the objective for drilling the well. It is also a function of the body of knowledge available, if any, from other wells drilled in the area.

FIG. 1 is an example of a number of commonly used logs. Nearly all wells have at least a resistivity log plus a spontaneous potential ("SP") log 45 prior to casing. The SP log 45 is a measurement of the natural electrochemical voltage that develops in rock because of drilling fluids contacting the natural fluids contained in the rock. Additionally, a gamma ray (GR) log 41 is usually run. This log measures the natural gamma ray radiation emitting from the rock surrounding the well. With some exceptions, this is a fairly good indicator of rock that may contain small pore spaces capable of holding fluids (water, oil, gas, injected hazardous waste, etc.). Generally, a low gamma ray count rate is associated with rock that may have porosity and therefore could contain fluids. There are many other types of logs. These are generally targeted at determining the amount of porosity and the type of rock (limestone, quartzite, dolomite, etc.) and the type of fluid that resides in the pore space if porosity exists.

For example, the logs depicted in FIG. 1 indicate that zones A and C are potential reservoirs because they have low gamma ray count rates and high porosity. Zones A and C are also likely to contain fluid because they have spontaneous potential (SP) ratings that deviate from the SP baseline. The resistivity log further indicates that zone A contains oil and/or gas because of its high resistivity, and that zone C has salty water because of its low resistivity. Zone B has no fluids due to its low porosity.

The instruments 20 used to measure these rock characteristics are lowered into the well on a steel strand, flexible cable (called a "wireline") 21 with conductors inside to power the instrument and transmit the readings to the surface. The cable is mounted on a winch on the back of a truck, or on a transportable platform for offshore work. The readings are processed by electronic surface equipment. The resulting data is then presented on film as a function of depth in the well.

Considering that wells generally range from 2,000 feet deep to 25,000 feet or more, accurate depth control can be a problem. Depth calibration of the cables must be done very carefully. Even so, it is not necessarily true that two different logging units will obtain exactly the same depths (i.e. sub-sea elevations) for a particular rock strata. Because of this, the first logs in the well become the standard depth reference. Subsequent log depths are adjusted or recalibrated to match the first logs.

After these openhole logs are completed, the well can then be cased. The purpose of casing in the well bore is to ensure that the well does not "cave in" (wall integrity) and that the various rock strata are isolated from each other (zone isolation). Zone isolation cannot be achieved by casing only. The casing must have cement placed in the annulus between the casing outer wall and the well bore wall perimeter. This is called cementing or grouting the casing. If the cement job is of good quality, rock strata at different depths are isolated from one another. In other words, fluids in one strata cannot flow to another strata through the annular area on the outside of the casing.

After the well has been cased and cemented, a cased hole gamma ray log is run inside the casing prior to perforation. The gamma ray log is used because it can "see" through the casing wall. The cased hole gamma ray count rate 42 will be reduced to a degree due to the shielding effect of the casing 12, but will generally track the openhole gamma ray count rate 41, as depicted in FIG. 4. Recalling the previous comments regarding depth control, one can see that the cased hole log depths may not be the same as the depths of the openhole log. Because the openhole log depths are defined as the standard, the cased hole log 42 is adjusted to overlay or agree with the openhole log 41. This process is called "tying in". The cased hole gamma ray log is a good choice for tying in because it works well for identifying rock strata, even though it is run inside the casing. Curves 43 and 44 in FIG. 4 demonstrate the types of error that can occur if the cased hole gamma ray log 42 is not properly tied in to the openhole gamma ray log 41.

Simultaneously with the cased hole gamma ray log, a casing collar locator is run. This combination is usually referred to as a PDC log (perforating depth control log). FIG. 3 shows a conventional tool string 30 used to run the PDC log within the cased well. The tool string includes a casing collar locator 32 spaced a predetermined vertical distance above a gamma ray sensor 34. The casing collar locator 32 identifies the depth of the casing collars (coupling/tool joints) 11. It does this by magnetically sensing the increased metal mass at the casing collar 11 which is greater than the rest of the casing 12. The resulting casing collar log indication is a spike 54 on the log baseline trace 51, as shown in FIG. 5. This is important because the casing collar locator 32 accurately places the depth of the casing collars 11 relevant to the depth standard set by the openhole log 41 (from FIG. 1). This assumes that the cased hole gamma ray log is correctly tied in to the openhole logs. This also assumes that the vertical displacement on the tool string between the gamma ray sensor 34 and casing collar sensor 32 is correctly accommodated. Because the PDC depth reference is normally based on the location of gamma ray sensor 34, the raw data from the casing collar log 51 will be off depth due to the vertical distance (usually a few feet) between the gamma ray sensor 34 and the casing collar sensor 32 on the tool string 30. This causes a need to adjust the recorded casing collar depths 54 to reflect the vertical distance between these sensors 32 and 34, as shown in FIG. 5. This distance must be incorporated into the final casing collar log 52 presentation for accurate subsequent cased hole work, as shown in FIG. 5. Herein lies one of the problems addressed by the new technique. The problem is that the casing collar log 51 can inadvertently remain uncorrected; or, it can be corrected the wrong distance; or, it can be corrected the wrong direction. The latter error causes a subsequent depth error of double the distance from the collar locator sensor 32 to the gamma ray sensor 34.

Collar locator depth displacement corrections are typically done a multitude of ways, including: (a) by manually redrawing the recorded log by an appropriate increment either uphole or downhole; (b) by memory capacitor banks or computer to shift the casing collar signal by an increment of depth before being printed onto the log; or (c) by shifting the ink pen which draws the log in the case of paper print out. In any of the foregoing techniques, the resultant depth corrected casing collar log 52 is only as good as the shift information contributed by the equipment operator. If the wrong casing collar depth correction information is used, the casing collar indications will be off depth. This will cause depth errors in virtually all subsequent cased hole wireline work, including perforating, because the casing collar log is the depth reference standard for those operations.

It is appropriate to add that other sensors may be run with the PDC log gamma ray sensor and collar locator sensor, such as a sensor for cement quality. This, however, only adds other log information. It does not change the issues outlined here. If anything, it makes the casing collar log depth correction process more complex and mistakes become easier to make.

After the PDC log is finished, the zone of interest must be perforated. Generally, a number of holes of about ½ inch diameter are punctured from the inside of the casing, through the casing wall, through the cement sheath, and into the surrounding rock formation. These perforations allow oil or other fluids to flow out of the rock formation into the inside of the casing. The fluid then flows up the casing to the surface for collection and transporting to its destination. Fluids intended for injection into the rock follow the opposite path, but the well mechanical configuration is the same. Wells that are part of water, carbon dioxide, or polymer flood projects are very similar to fluid disposal using injection wells.

Though there are various ways to create perforations, the vast majority are done with a wireline explosive tool known as a perforating gun 20, as shown in FIG. 2. The perforating gun 20 is typically run into the well 10 with a collar locator sensor 22 attached. The collar locator recorded depths are adjusted until the perforating gun collar indications overlay (in depth) exactly with the collar locator indications 53 from the corrected PDC log 52 shown in FIG. 5. Once this is accomplished, the gun 20 can be placed at the appropriate depth, as determined by analysis of the openhole logs. Once the gun 20 is positioned, it is fired by an electrical current transmitted through the cable 21 from the surface which detonates a blasting cap attached to the gun. This, in turn via primacord, detonates individual shaped charges 25 which perforate the casing, cement, and surrounding rock.

The most common cased hole operational errors causing the well to be perforated off depth (i.e. perforations misaligned with the rock strata of interest) can be summarized as follows:

1. Incorrect depth shifting of the collar locator indications 54, either by the wrong distance, the wrong direction or both. This accounts for approximately 60% of the errors in the applicant's observations during almost 30 years in the business.

2. Tying in to the wrong casing collar 11. Because oil field casing joints tend to be approximately 30 feet in length, this creates at least a 30 foot error in perforated intervals. This accounts for approximately 30% of the errors in the applicant's observations.

3. Other types of errors account for approximately 10% of the errors in the applicant's observations.

It should be added that many of the interesting rock strata can be only 10 or 20 feet in thickness. Therefore, these errors can cause the perforations to partially (or even totally!) miss the zone of interest. At the very least, the well must be re-perforated after time-consuming failures to establish production. On the other extreme, an undesirable zone may have been perforated by the depth error. For example, a water zone may have been perforated in an oil/gas well causing production and disposal costs to increase dramatically. It is not only expensive to plug perforations that are in a location causing production/injection problems. The plugging operation can occasionally develop such serious problems that the well must be abandoned and re-drilled.

3. Prior Art

A number of magnetic or radioactive markers have been invented in the past to assist in well depth control, including the following:

| Inventor | U.S. Pat. No. | Issue Date |
|---|---|---|
| Goble | 2,728,554 | Dec. 27, 1955 |
| Ternow | 3,019,841 | Feb. 6, 1962 |
| Doak | 3,106,960 | Oct. 15, 1963 |
| Frye | 3,144,876 | Aug. 18, 1964 |
| Pennebaker | 3,145,771 | Aug. 25, 1964 |
| Bryant | 3,288,210 | Nov. 29, 1966 |
| Rike | 3,291,207 | Dec. 13, 1966 |
| Kenneday | 3,291,208 | Dec. 13, 1966 |
| Schuster, et al. | 3,396,786 | Aug. 13, 1968 |
| Hamilton | 3,570,594 | Mar. 16, 1971 |
| Spidell, et al. | 3,776,323 | Dec. 4, 1973 |
| Pitts, Jr. | 4,189,705 | Feb. 19, 1980 |
| Talbot | 4,244,424 | Jan. 13, 1981 |
| Hoehn, Jr. | 4,465,140 | Aug. 14, 1984 |

Blaskowsky, et al., "Magnetic Markers Simplify Well Depth Correlations", World Oil, Nov. 1979, pp. 64–68.

Doak discloses an attachable collar for placement on a section of casing at one or more points along the casing string. The collar carries a marker that coacts with a sensing instrument to provide a depth indication. The marker means for elements 24 may be permanent magnets (col. 5, line 73 through col. 6, line 41), or as shown in FIG. 5*a*, a plurality of marker elements utilizing a magnetic, radioactive and/or radioactivity shielding material. The device provides a final correlation log output (e.g. FIG. 9) that shows a gamma ray or other radioactive indication 62, 64 as well as marker lines 58, 60.

The Talbot patent and the article by Blaskowsky, et al., disclose a magnetic marker that attaches to the casing to simplify well depth correlation. Magnetic markers of this type are commercially available from Gemoco of Louisiana, and its licensees. Magnetic markers are useful in determining whether the perforating gun is tied in to the correct collar, rather than another one uphole or downhole. Because the magnets in the device cause a unique collar indication, this would not likely be confused with any of the true collar signals which all look basically alike. However, magnetic markers do not address the problem of incorrectly shifting the PDC casing collar log either by the wrong distance or direction when running the PDC log.

This problem of tying in to the wrong collar during the perforating run is also addressed by the use of a casing "pup" joint. A pup joint is a short length of casing compared to the usual lengths of joints in the well (e.g. in the oil field, a pup joint might be 5 or 10 feet in length compared to the 30 feet typical joint length). When in the well with a perforating gun with a collar locator attached, the wireline operator knows that the correct collar is tied in when the short joint is recorded in the correct place. But again, the pup joint technique does not address potential errors caused by incorrectly shifting the casing collar log either by the wrong distance or direction when running the PDC log.

Pennebaker utilizes a radioactive pill 16 that is embedded in selected collars 24 along depths of interest in the casing string. This device also uses a downhole radiation source and is primarily used for location of a perforator relative to single tubing perforation when multiple tubing strings extend within the casing.

Schuster discloses a depth control apparatus having a collar locator 24 that is designed to detect previously located magnetic anomalies such as a short "pup" joint in the casing string 13. Schuster notes that it is possible to use other detecting means in conjunction with the locator 24, and that such other means can detect identifiable geologic formation characteristics such as the natural or induced radioactivity of earth formations.

Kenneday teaches the use of a radioactive pill 15 embedded in one or more of the pipe strings 12 in a multiple "tubingless" completion. A sensing instrument measures radioactivity from the pill to aid in depth measurement.

Rike uses leaded collars to provide an inverse radioactivity function. Each collar shields natural radioactivity in the surrounding formation and thereby creates a distinctive radioactivity log at those depths where a leaded collar has been inserted.

Hoehn, Jr. discloses a method of magnetizing the well casing in which the direction of the magnetic field is periodically reversed to create a plurality of magnetic flux leakage points along the well casing.

The remainder of the references cited disclosed various forms of downwell control systems and orientation devices that are of general interest only.

4. Solution to the Problem

None of the prior art references uncovered in the search show a method for wireline depth control using a combined magnetic and radioactive marker attached to the casing to ensure both: (1) that the PDC log is tied in to the correct casing collar; and (2) that the collar locator indications on the PDC log are shifted correctly to account for the vertical distance between the gamma ray sensor and the collar locator sensor.

This invention provides an improved method of wireline operation depth control in cased wells. An openhole gamma ray log is performed of the relevant zone of interest of the well prior to casing. A combined magnetic and radioactive marker is attached to the casing in the vicinity of the zone of interest. After casing has been run into the well and cemented, a cased hole log is then performed, such as a perforation depth control (PDC) log, using both a casing collar locator and a gamma ray sensor. The marker produces distinctive spikes on the logs from both sensors. The casing collar log is tied in to the gamma ray log simply by aligning these distinctive spikes on both logs.

A primary object of the present invention is to provide a method to ensure accurate correction of the casing collar log to tie in to the gamma ray log.

Another object of the present invention is to provide a method to ensure that the casing collar log is tied in to the correct casing collar.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 2 also shows a cross-section of the cased well.

FIG. 3 also shows a cross-section of the cased well.

FIG. 4 is a simplified example of the openhole gamma ray log 41 from FIG. 1 overlaid with the cased hole gamma ray log 42 correctly tied in. This figure also snows two examples 43 and 44 in which the cased hole gamma ray log has not been correctly tied in.

DETAILED DESCRIPTION OF THE INVENTION

Figure 1:
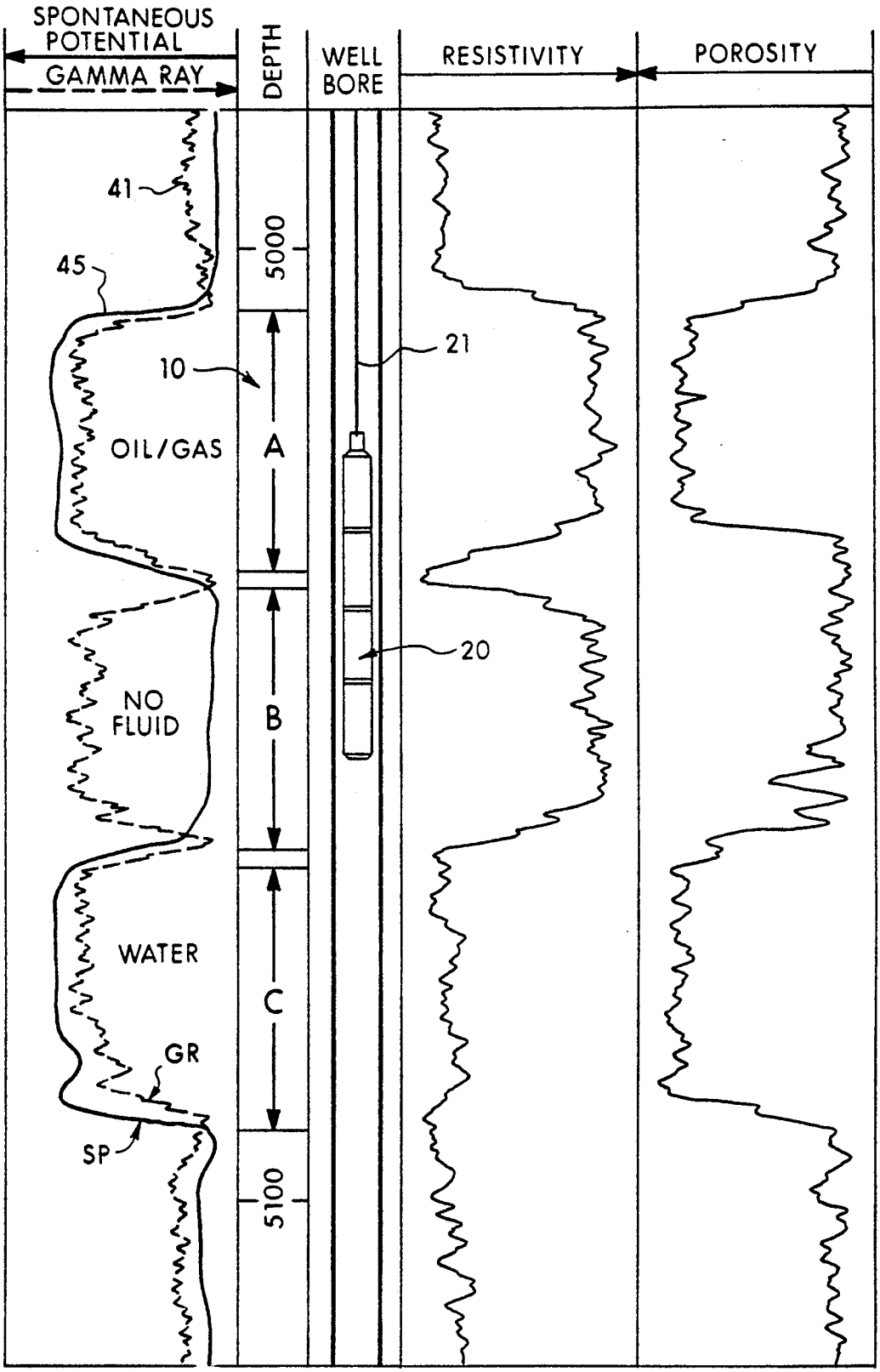
FIG. 1 is a simplified graph of sample openhole logs showing gamma ray, spontaneous potential, resistivity, and porosity readings along the depth of the well.

Under the present invention, the well is initially drilled and openhole logs (e.g. FIG. 1) are prepared as previously discussed. In particular, an openhole gamma ray log 41 is typically performed prior to casing the well.

As the casing string 12 is lowered into the well, a marker 15 is attached to the casing at a point such that the marker will be located near a zone of interest in the cased well as determined from the openhole logs. This marker 15 is preferably secured to the exterior of the casing, since most well operators do not like devices that restrict the inside bore of the casing. The marker is outfitted with a number of magnets and a radioactive source of sufficient strength to create a distinctive magnetic and radioactive characteristic within the casing. The radioactive source can be a small quantity of a radioactive isotope such as radium 226 or cobalt 60 that produces gamma radiation.

Figure 8:
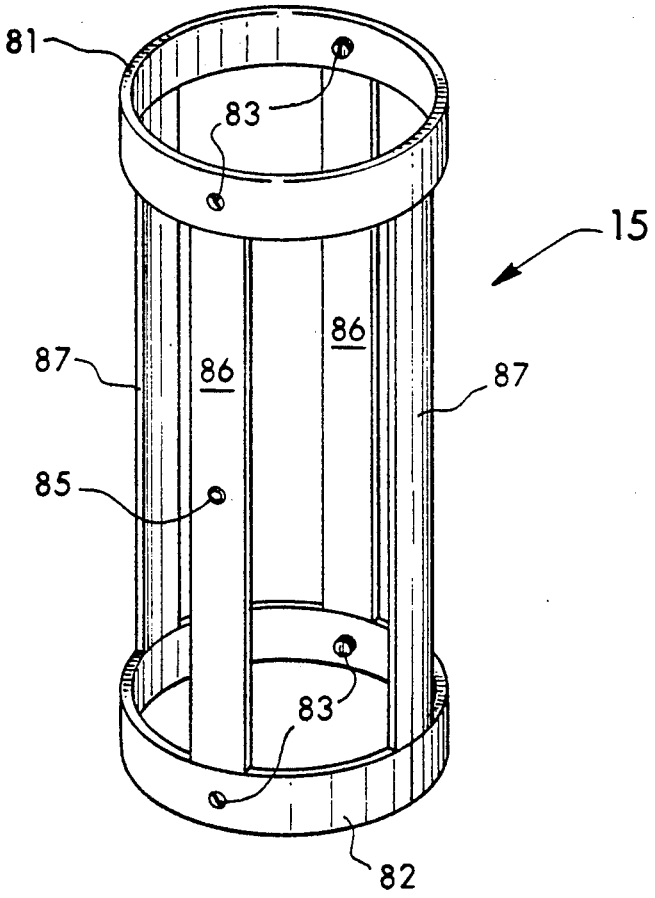
FIG. 8 is a perspective view of a combined magnetic and radioactive marker that can be attached to the outside of the casing string.

FIG. 8 shows one possible embodiment of such a marker 15 having upper and lower rings 81 and 82 separated a predetermined distance apart by two support members 86. The rings are attached to the outside of the casing 12 by means of a number of set screws 83. A number of bar magnets 87 extend between the rings 81 and 82 adjacent to the exterior of the casing. The type of magnetic material and construction is not critical provided the magnetic flux field is sufficient to penetrate the casing wall and cause a collar locator signal that is very obviously different from an ordinary collar signal. A small radioactive pill 85 is secured to the marker 15. Alternatively, an existing magnetic marker, such as the Gemoco device, can be retrofitted with a radioactive source.

Figure 3:
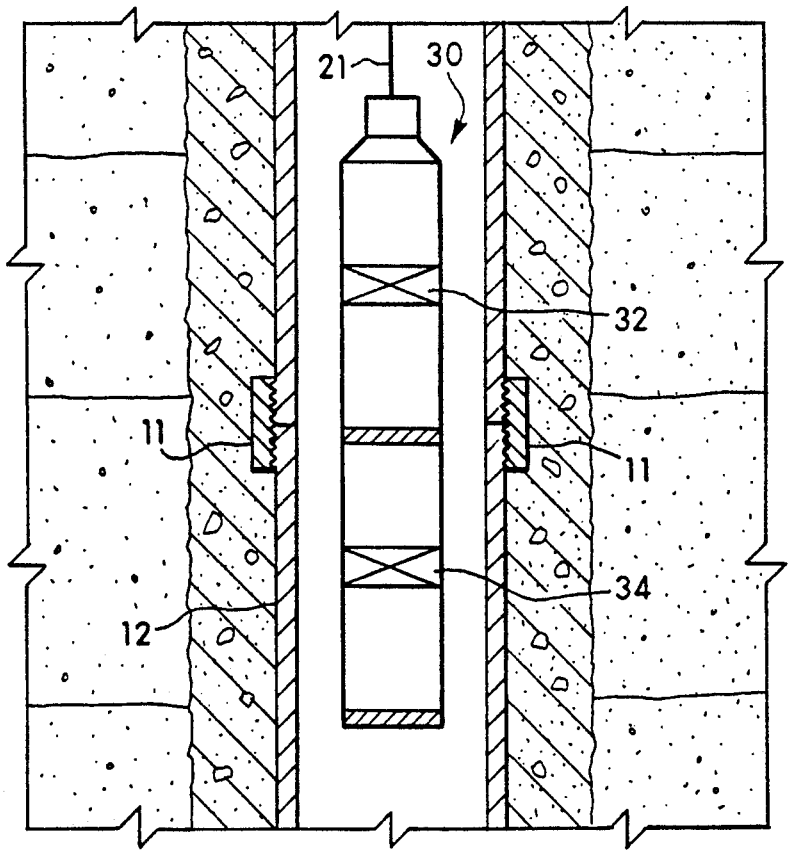
FIG. 3 is a simplified vertical cross-sectional view of a typical perforating depth control (PDC) tool 30.
Figure 4:
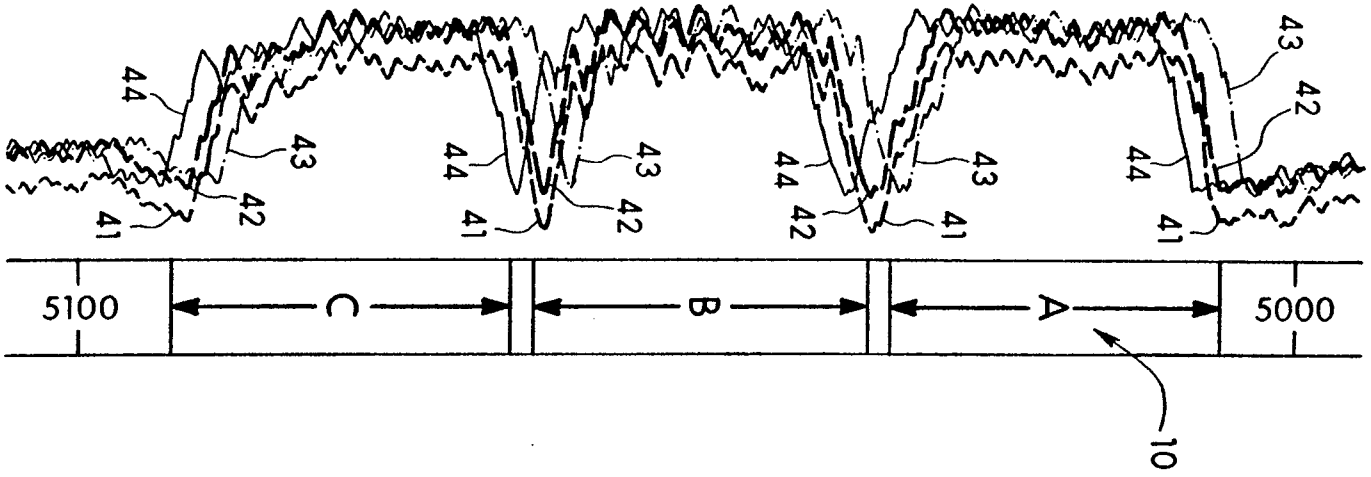
Figure 5:
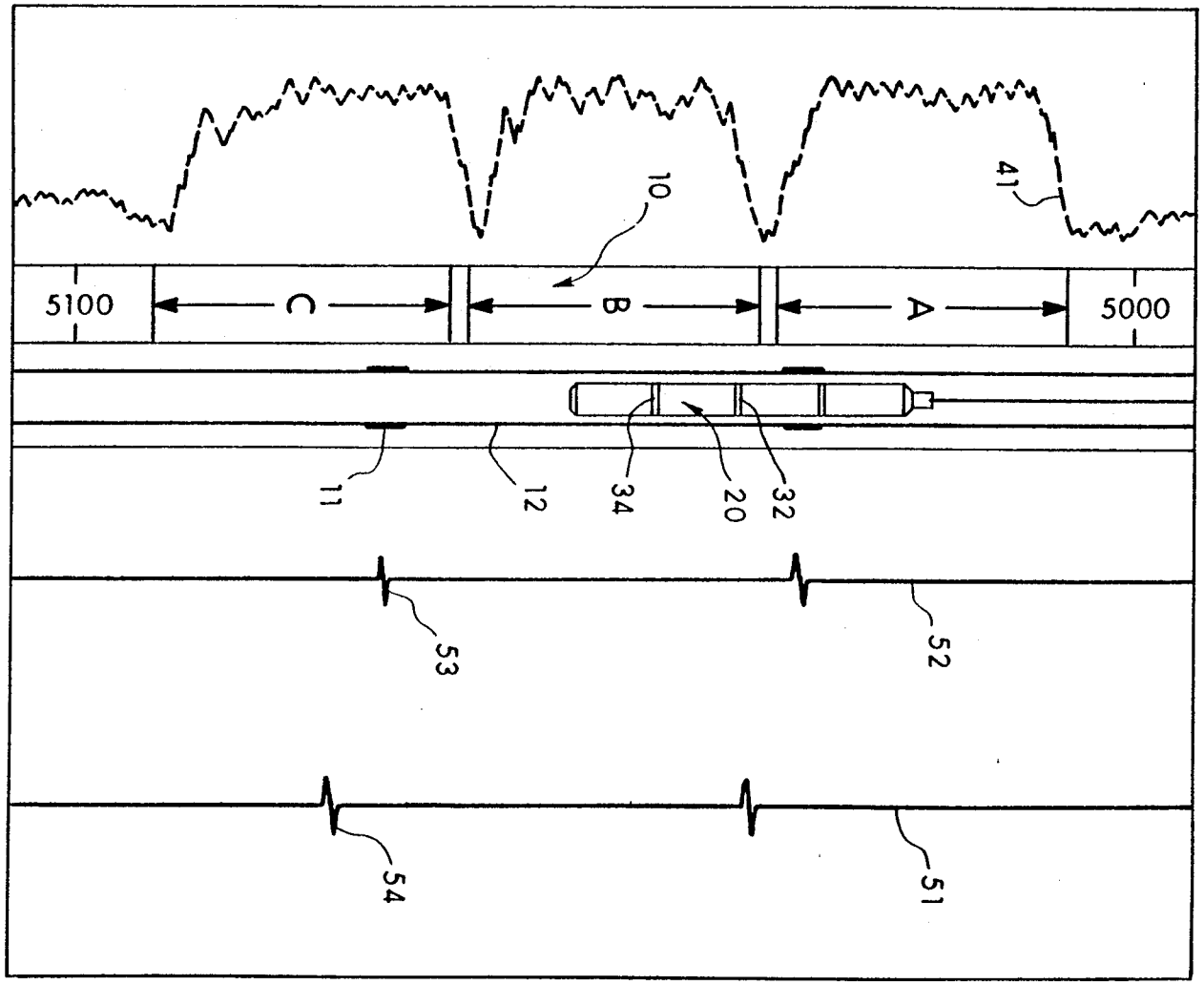
FIG. 5 is a simplified graph showing the results of a typical PDC log. In particular, the cased hole gamma ray log 41 is shown on the left. The uncorrected log 51 from the PDC casing collar locator is shown on the right. The corrected casing collar locator log 52 has been accurately adjusted by the vertical distance between the PDC gamma ray sensor and the collar locator sensor to correspond to the actual locations of the collars 11.

The well is then cemented in the conventional manner after the casing 12 and attached marker 15 have been placed into the well. A cased hole log is then required to accurately locate and tie in the casing collars to the openhole gamma ray log 41, as previously discussed. For example, this can be accomplished running a PDC log using a tool string having a casing collar locator 32 and a gamma ray sensor 34, as shown in FIG. 3.

Figure 6:
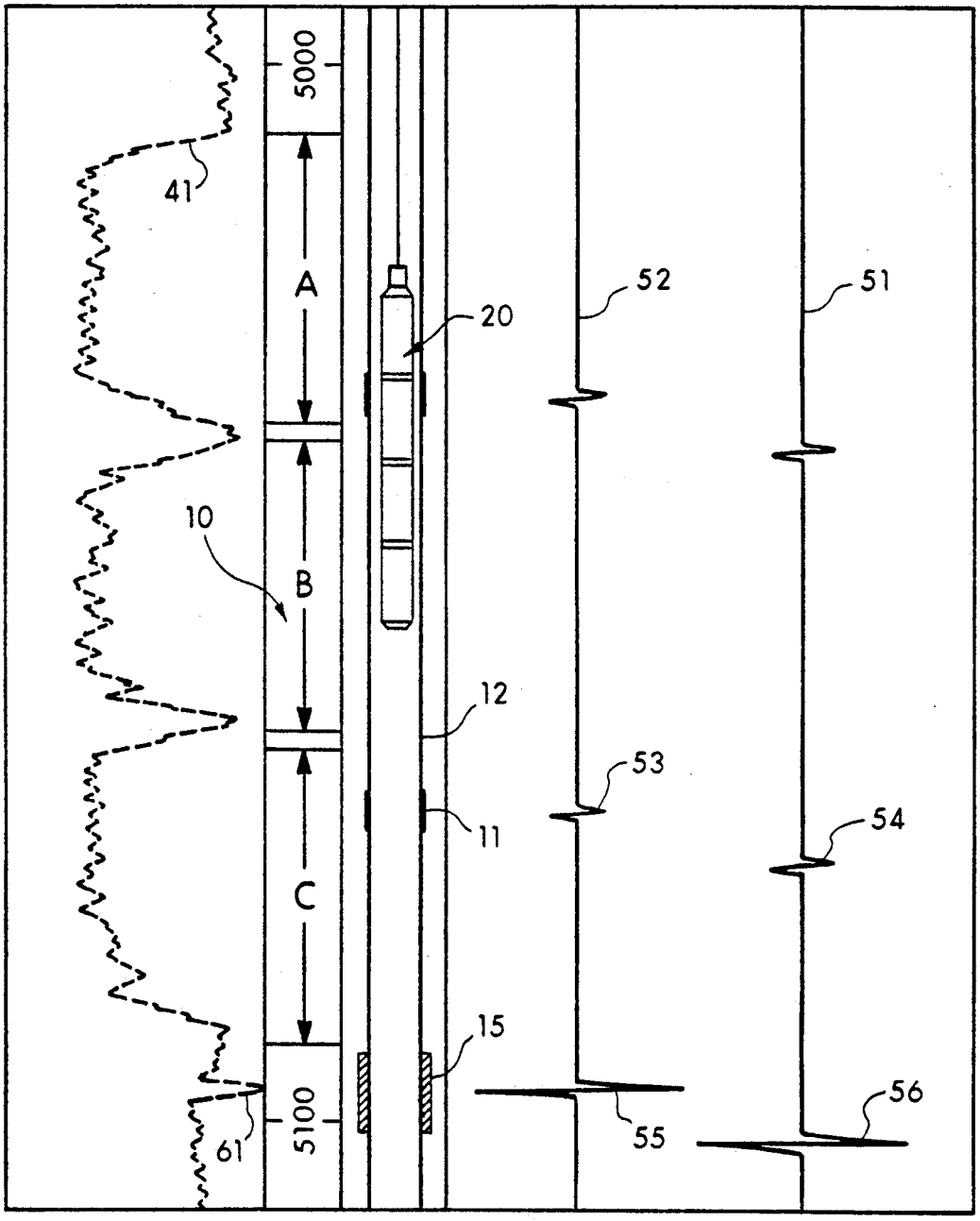
FIG. 6 is a simplified graph similar to FIG. 5 showing the results of a PDC log using a combined magnetic and radioactive marker attached to the casing in accordance with the present invention.

The results of a PDC log using a marker in accordance with the present invention are shown in FIG. 6. Note that the gamma ray log 41 shown on the left of FIG. 6 now includes a distinctive spike 61 caused by the radioactive source 85 on the marker 15. The cased hole gamma ray log is tied in to the previous openhole gamma ray log by pattern matching, as previously discussed. The only major difference between the two gamma ray logs (other than a slight reduction on the cased hole gamma ray log due to the shielding effect of the casing) should be the addition of the distinctive spike 61 on the cased hole log caused by the marker 15.

It should also be noted that the casing collar log 51 shown on the right of FIG. 6 now includes a distinctive spike 56 caused by the magnets 87 on the marker 15, which is easily distinguished from the series of smaller spikes 54 caused by each of the casing collars 11. The casing collar log 51 is corrected simply by shifting upward or downward until the distinctive spike 56 is aligned with the gamma ray log spike 61. The corrected casing collar log 52 is shown in the middle portion of FIG. 6.

Thus, the present invention provides a simple method for ascertaining that the casing collar log depth correction (shift) has been done the appropriate direction and distance. In addition the marker 15 helps ensure that the perforating gun (or other wireline service tied in with a collar locator) is tied in to the correct collar, rather than another one uphole or downhole. The magnets 87 in the marker 15 cause a unique looking collar indication 56 that is not likely to be confused with any of the true collar signals 54, which all look basically alike. Magnetic markers, such as the Gemoco tool, are intended to address this latter problem without the radioactive source. However, in the applicant's observations over the years in the oil industry, the addition of a radioactive source to a magnetic marker would effectively triple its value in avoiding cased hole depth control mistakes arising from both types of errors.

Figure 2:
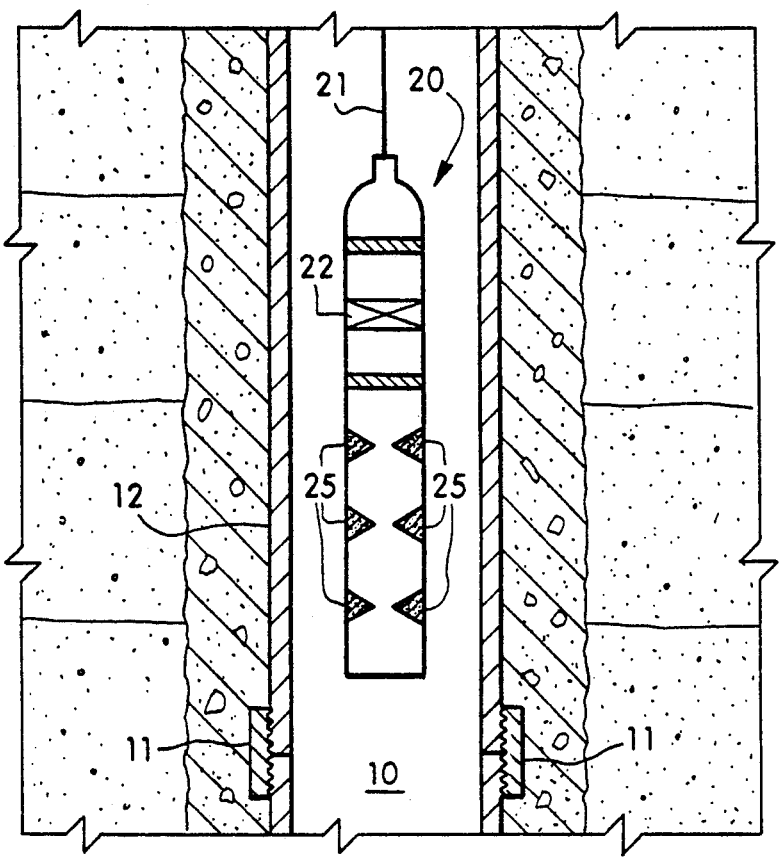
FIG. 2 is a simplified vertical cross-sectional view of a conventional perforating gun 20 with a collar locator sensor 22.

After the cased hole PDC log is completed, the well can be perforated, if desired. A conventional perforating tool 20 has a casing collar locator 22 and a plurality of shaped charges 25, as shown in FIG. 2. Perforating tools do not usually include a gamma ray sensor, because the sensor requires an electrical power supply that could accidently trigger the perforation charges 25. The wireline operator monitors the casing indications produced by the casing collar locator 22 as the perforating tool 20 is lowered into the well. The casing collar log from the previous PDC run and the casing collar sensor on the perforating gun are used by the operator to position the perforating tool at the desired depth for perforating the well.

In one alternative embodiment of the marker 15, the radioactive source 85 is replaced with non-radioactive material that becomes radioactive for a short period of time following neutron bombardment. With the passing of a short period of time, this material decays back to a harmless state. Wireline tools to activate the material are readily available from several wireline service companies. This alternative embodiment has several advantages from the standpoint of safety, transportation, and environmental protection. Examples of elements suitable for this purpose are manganese, gold, and possibly silver. These have appropriate half-lives when activated by neutron energies found in conventional oil field neutron logging tools, and emit gamma rays that are easily detected by conventional oil field gamma ray sensors.

Figure 7:
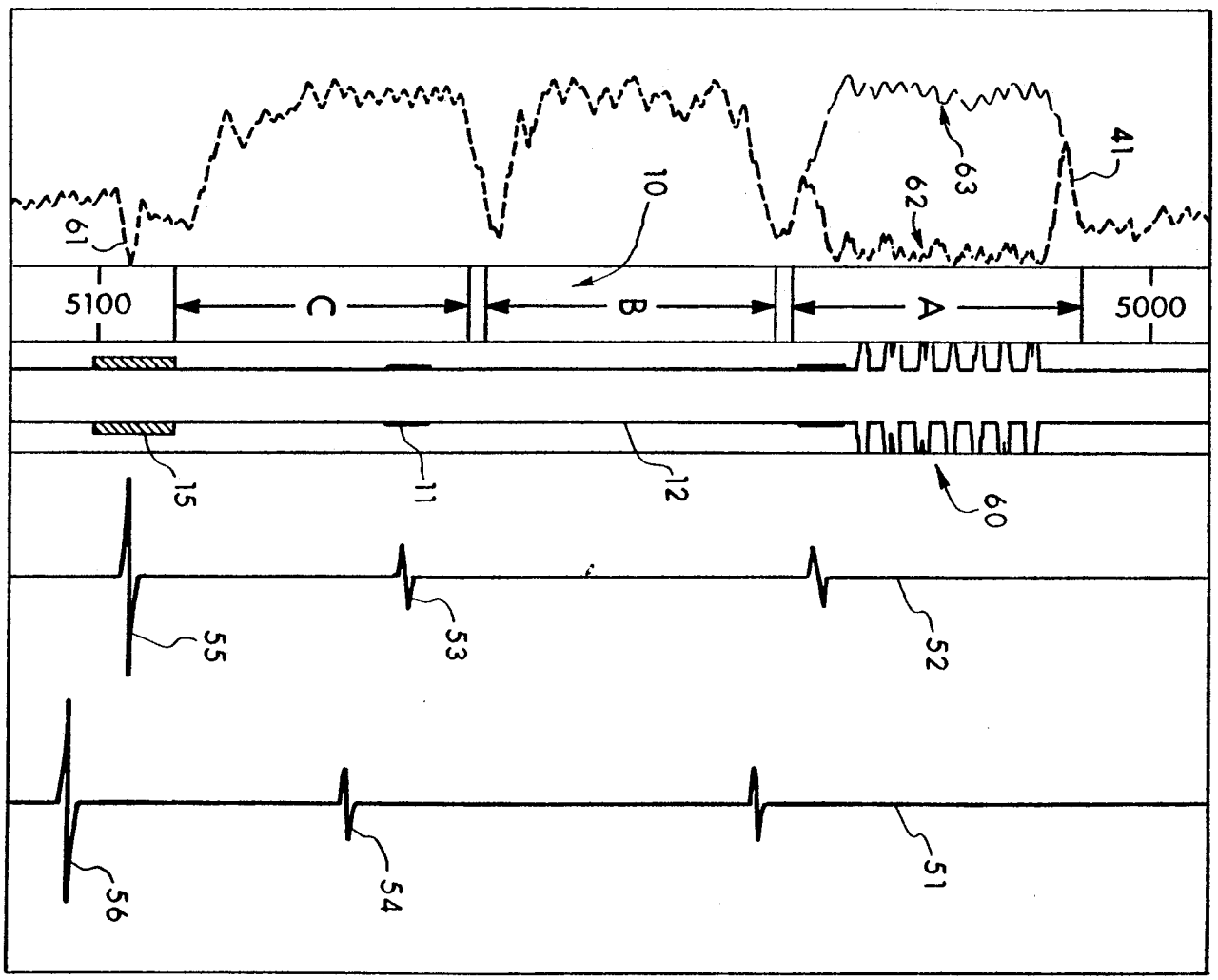
FIG. 7 is a simplified graph showing the results of a PDC log after the well has been perforated in an alternative version of the present invention.

This same non-radioactive material can also be placed in the perforating explosive shaped charges. Thus, a neutron bombardment and an additional PDC log *after* perforating gives an exact indication 62 of the placement of the perforations 60 in the well as shown in FIG. 7. This same material also can be placed in other cased hole mechanical devices such as packers, storm valves, casing patches, etc. This embodiment offers a verifiable tie in trail of the complete process back to the original openhole log.

In the case of tubingless completions (i.e. small tubing used as casing), the same principles and procedures can be applied. Only the clamp sizes for the device and the diameters of the necessary wireline tools would be different. In case of non-ferrous casings (e.g. fiberglass or plastic), the technique is unchanged if steel/iron rings are placed in the collars for depth control purposes, making the process similar to that for steel casing. If steel/iron rings are not used, as is common, then this technique becomes more important, in that it may be the only system available beyond raw wireline depth measurements.

The above disclosure sets forth a number of embodiments of the present invention. Other arrangements or embodiments, not precisely set forth, could be practiced under the teachings of the present invention and as set forth in the following claims.

I claim:

1. A method for wireline operation depth control in a cased well comprising the following sequence of steps:

performing an openhole gamma ray log of the relevant zone of interest of said well prior to casing;

casing said well with a casing string having a marker with distinctive magnetic and radioactive characteristics attached to said casing in the vicinity of said zone of interest;

performing a cased hole log of said well using a tool string having a gamma ray sensor and a casing collar sensor;

tying the cased hole gamma ray log to said openhole gamma ray log; and tying the casing collar log to said cased hole gamma ray log by shifting said casing collar log to align the distinctive magnetic indication caused by said marker with the distinctive radioactive indication caused by said marker on said cased hole gamma ray log.

2. The method of claim 1 wherein said cased hole log is a perforating depth control (PDC) log.

3. The method of claim 1, wherein said marker comprises a pill of non-radioactive material prior to casing said well, and wherein said method further comprises the additional step of subjecting said pill to neutron bomdardment to cause said pill to become radioactive prior to performing said cased hole logs.

4. The method of claim 1, wherein said marker comprises:

at least one collar to fit over the exterior of said casing;

means for securing said collar to said casing;

at least one magnet secured to said marker; and a radioactive source attached to said marker.

5. The method of claim 1, wherein said marker comprises:

at least two substantially circular collars having a diameter sufficient to fit over the exterior of said casing;

means for securing at least one of said collars to said casing;

a plurality of bar magnets, each extending between two of said collars; and a radioactive source attached to said marker.

6. A method for wireline operation depth control in a cased well comprising the following sequence of steps:

performing an openhole gamma ray log of the relevant zone of interest of said well prior to casing;

casing said well with a casing string having a marker with distinctive magnetic and radioactive characteristics attached to said casing in the vicinity of said zone of interest;

performing a perforation depth control (PDC) log of said well using a tool string having a gamma ray sensor and a casing collar sensor spaced a vertical distance apart from one another;

tying the PDC gamma ray log to said openhole gamma ray log;

correcting the casing collar indications in said PDC log by shifting said casing collar indications to align the distinctive magnetic indication caused by said marker with the distinctive radioactive indication caused by said marker on said PDC gamma ray log; and perforating said well using perforating gun having casing collar locator to control the depth of said perforations based on the corrected casing collar indications of said PDC log.

7. The method of claim 6, wherein said marker comprises:

at least one collar to fit over the exterior of said casing;

means for securing said collar to said casing;

at least one magnet secured to said marker; and a radioactive source attached to said marker.

8. The method of claim 6, wherein said marker comprises:

at least two substantially circular collars having a diameter sufficient to fit over the exterior of said casing;

means for securing at least one of said collars to said casing;

a plurality of bar magnets, each extending between two of said collars; and a radioactive source attached to said marker.

9. The method of claim 6, wherein said marker comprises a pill of non-radioactive material prior to casing said well, and wherein said method further comprises the additional step of subjecting said pill to neutron bomdardment to cause said pill to become radioactive prior to performing said PDC log.

10. The method of claim 9, wherein said non-radioactive material comprises manganese.

11. The method of claim 9, wherein said non-radioactive material comprises gold.

12. The method of claim 9, wherein said non-radioactive material comprises silver.

13. The method of claim 9, wherein said non-radioactive material is placed in the perforating charges of said perforating gun, and said method comprises the following additional steps after perforation of the well:

subjecting said perforations to neutron bomdardment to cause said material carried by said charges to become radioactive;

performing a gamma ray log to confirm the depth of said perforations.

14. A method for wireline operation depth control in a cased well comprising the following sequence of steps:

performing an openhole gamma ray log of the relevant zone of interest of said well prior to casing;

casing said well with a casing string having a magnetic marker attached to said casing in the vicinity of said zone of interest, said marker also having a quantity of non-radioactive material that can be activated by neutron bombardment to emit gamma radiation;

subjecting said marker to neutron bombardment;

performing a perforation depth control (PDC) log of said well using a tool string having a gamma ray sensor and a casing collar sensor spaced a vertical distance apart from one another;

tying the PDC gamma ray log to said openhole gamma ray log;

correcting the casing collar indications in said PDC log by shifting said casing collar indications to align the distinctive magnetic indication caused by said marker with the distinctive radioactive indication caused by said marker on said PDC gamma ray log; and perforating said well using perforating gun having casing collar locator to control the depth of said perforations based on the corrected casing collar indications of said PDC log.

15. The method of claim 14, wherein said non-radioactive material is placed in the perforating charges of said perforating gun, and said method comprises the following additional sequence of steps after perforation of the well:

subjecting said perforations to neutron bomdardment to cause said non-radioactive material carried by said charges to emit gamma radiation; and performing a gamma ray log to confirm the depth of said perforations.

16. The method of claim 14, wherein said marker comprises:

at least one collar to fit over the exterior of said casing;

means for securing said collar to said casing;

at least one magnet secured to said marker; and a quantity of said non-radioactive material attached to said marker.

17. The method of claim 14, wherein said marker comprises:

at least two substantially circular collars having a diameter sufficient to fit over the exterior of said casing;

means for securing at least one of said collars to said casing;

a plurality of bar magnets, each extending between two of said collars; and a pill of said non-radioactive material attached to said marker.

* * * * *